US006834176B2

(12) United States Patent
Saito et al.

(10) Patent No.: US 6,834,176 B2
(45) Date of Patent: Dec. 21, 2004

(54) IMAGE FORMING APPARATUS HAVING INTERMEDIARY TRANSFER MEMBER AND TRANSFER MEMBER OF SIZE AND HARDNESS, RESPECTIVELY, SATISFYING SPECIFIC FORMULA

(75) Inventors: Makoto Saito, Toride (JP); Takeshi Tomizawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 10/171,611

(22) Filed: Jun. 17, 2002

(65) Prior Publication Data

US 2003/0002892 A1 Jan. 2, 2003

(30) Foreign Application Priority Data

Jun. 15, 2001 (JP) ..... 2001/181581

(51) Int. Cl.[7] ..... G03G 15/01
(52) U.S. Cl. ..... 399/302; 399/308
(58) Field of Search ..... 399/297, 298, 399/299, 302, 308, 66

(56) References Cited

U.S. PATENT DOCUMENTS 6,223,015 B1 * 4/2001 Takahata et al. ..... 399/302
6,253,041 B1 6/2001 Tomizawa et al. ..... 399/66
6,360,071 B1 3/2002 Tomizawa ..... 399/302

FOREIGN PATENT DOCUMENTS

JP 7-271201 10/1995
JP 8-160763 6/1996
JP 2000-155476 6/2000

* cited by examiner

*Primary Examiner*—Hoan Tran
(74) *Attorney, Agent, or Firm*—Fitzpatrick, Cella, Harper & Scinto

(57) ABSTRACT

An image forming apparatus has an image bearing member for carrying a developed image; image forming unit for forming a developed image on said image bearing member; an intermediary transfer member onto which a developed image on said image bearing member is transferred; a transfer member, disposed at a position opposed to said image bearing member with the intermediary transfer member therebetween, for primary transfer of the developed image from said image bearing member onto said intermediary transfer member by application of a voltage thereto and pressing said intermediary transfer member to said image bearing member, transferring means for secondary transfer of the developed image from said intermediary transfer member onto a transfer material; wherein a maximum height Rmax ($\mu$m) representing a surface shape of said intermediary transfer member onto which the developed image is transferred, an average inclination angle θa (°) representing a surface shape of said intermediary transfer member onto which the developed image is transferred, an urging force P (N) of said transfer member onto said intermediary transfer member, and ASKER C hardness of said transfer member R (°) satisfy:

$$\theta a < 2.355 \times (P+11.4)/(R+94.2) - 0.0174 \times Rmax.$$

10 Claims, 11 Drawing Sheets

$$\theta a = \tan^{-1}\left(\frac{\Sigma Hn}{W}\right)$$

| INTERMEDIARY TRANS. BELT | IMAGE LEVEL (ROLLER HARDNESS) | | | Rmax | θa |
|---|---|---|---|---|---|
| | 10° | 20° | 35° | | |
| I | × | × | × | 29 | 0.577 |
| | × | × | × | 13.12 | 0.309 |
| | × | × | × | 12.88 | 0.258 |
| | × | × | × | 12.45 | 0.243 |
| | ○ | × | × | 11.33 | 0.206 |
| | ○ | △ | × | 8.98 | 0.2 |
| II | × | × | × | 19.37 | 0.233 |
| | × | × | × | 13.42 | 0.2 |
| | ○ | ○ | ○ | 8.57 | 0.153 |
| | ○ | ○ | ○ | 8.42 | 0.156 |
| | △ | △ | × | 13.51 | 0.118 |
| III | × | × | × | 17.23 | 0.346 |
| | × | × | × | 8.37 | 0.288 |
| | ○ | △ | × | 7.34 | 0.231 |
| | ○ | △ | △ | 6.27 | 0.225 |
| | △ | △ | × | 6.19 | 0.287 |
| | △ | △ | × | 4.52 | 0.324 |

○ NO DEFECT

△ FAIR

× NO GOOD

FIG. 6

| INTERMEDIARY TRANS. BELT | IMAGE LEVEL (PRESS. DIFF) | | | Rmax | θa |
|---|---|---|---|---|---|
| | 4.9N | 7.8N | 19.6N | | |
| I | × | × | × | 29 | 0.577 |
| | × | × | △ | 13.12 | 0.309 |
| | × | × | ○ | 12.88 | 0.258 |
| | × | × | ○ | 12.45 | 0.243 |
| | × | ○ | ○ | 11.33 | 0.206 |
| | △ | ○ | ○ | 8.98 | 0.2 |
| II | × | × | △ | 19.37 | 0.233 |
| | × | × | ○ | 13.42 | 0.2 |
| | ○ | ○ | ○ | 8.57 | 0.153 |
| | ○ | ○ | ○ | 8.42 | 0.156 |
| | △ | △ | ○ | 13.51 | 0.118 |
| III | × | × | × | 17.23 | 0.346 |
| | × | × | ○ | 8.37 | 0.288 |
| | △ | ○ | ○ | 7.34 | 0.231 |
| | △ | ○ | ○ | 6.27 | 0.225 |
| | × | △ | ○ | 6.19 | 0.287 |
| | × | △ | ○ | 4.52 | 0.324 |

○ NO DEFECT

△ FAIR

× NO GOOD

FIG. 9

IMAGE FORMING APPARATUS HAVING INTERMEDIARY TRANSFER MEMBER AND TRANSFER MEMBER OF SIZE AND HARDNESS, RESPECTIVELY, SATISFYING SPECIFIC FORMULA

FIELD OF THE INVENTION AND RELATED ART

The present invention relates to an image forming apparatus such as a copying machine, a facsimile machine, a printer, or the like, which employs an electrophotographic or electrostatic recording method. In particular, it relates to an image forming apparatus of an indirect transfer type, in which an image made up of developer on an image bearing member is transferred onto an intermediary transfer member.

As for a typical electrophotographic image forming apparatus, an image forming apparatus such as the one shown in FIG. 10 has been known.

The image forming apparatus 200 in FIG. 10 is provided with an electrophotographic photoconductive member, in the form of a drum, that is, a photoconductive drum 1, as an image bearing member. The photoconductive member 1 is rotationally supported and is rotationally driven by a driving means (unshown) in the direction indicated by an arrow mark in the drawing. Surrounding the photoconductive drum 1 are a charging means 2, an exposing means 3, a developing means 4, and a cleaning means 10. Further, placed next to the photoconductive drum 1 are an intermediary transfer belt 6 as an intermediary transferring member, and a primary transferring means 5 which is positioned in a manner to sandwich the intermediary transfer belt 6 between itself and photoconductive drum 1.

The photoconductive drum 1 comprises an aluminum cylinder, and a layer of organic photoconductor (OPC) coated on the peripheral surface of the aluminum cylinder. The charge roller 2 comprises a metallic core, an electrically conductive rubber layer, and a surface layer, listing from the inward side. The electrical resistance of the surface layer is in the mid range. The charge roller 2 is placed in contact with the peripheral surface of the photoconductive drum 1. The peripheral surface of the photoconductive drum 1 is uniformly charged by applying to the charge roller 2 a bias (charge bias), which is a combination of DC and AC biases. The exposing means 3 emits a beam of laser light in response to signals in accordance with the image formation data inputted into a laser driver, exposing the uniformly charged peripheral surface of the photoconductive drum 1. As a result, an electrostatic latent image is formed on the peripheral surface of the photoconductive drum 1.

The developing means 4 is a rotary developing means comprising developing devices 4Y, 4M, 4C, and 4K for developing the electrostatic latent images into toner images of yellow (Y), magenta (M), cyan (C), and black (B), respectively. When developing the electrostatic latent images into toner images different in color, the rotary developing means 4 is rotated so that the developing devices different in the color of the developer contained therein are moved one by one to the location, at which developing devices oppose the photoconductive drum 1. As a result, the developers different in color are adhered to the peripheral surface of the corresponding photoconductive drum 1 in a manner to reflect the pattern of the corresponding electrostatic latent images on the peripheral surface of the photoconductive drum 1, forming images made up of the developers (toner images).

The intermediary transfer belt 6 is stretched around four rollers: a driving roller 61, a tension roller 62, a follower roller 63, and a primary transfer roller 5, and is moved (rotationally driven) in the direction indicated by an arrow mark in the drawing. Each of the toner image, which are formed on the photoconductive drum 1 and are different in color, is sequentially transferred onto the intermediary transfer belt 6 by applying the primary transfer electric field to the primary transfer roller 5 as the primary transferring means disposed at a location at which the intermediary transfer belt 6 is pinched between the photoconductive drum 1 and primary transfer roller 5. There is also the secondary transfer roller 8 as the secondary transferring means, which is disposed at a location where it opposes the follower roller 63, with the intermediary transfer belt 6 pinched between the secondary transfer roller 8 and follower roller 63. The toner images placed in layers on the intermediary transfer belt 6 are transferred all at once by applying the secondary transfer electric field to the secondary transfer roller 8, onto a recording medium P.

The cleaning means 10 for the photoconductive drum 1 is disposed downstream from the primary transfer station T, in terms of the direction in which the photoconductive drum 1 is driven. It removes the transfer residual toner particles, that is, the toner particles which were not transferred onto the intermediary transfer belt 6 in the primary transfer station T and remained on the photoconductive drum 1.

The cleaning means 11 for the intermediary transfer belt 6 is disposed on the downstream side of the secondary transfer station T', in terms of the direction in which the intermediary transfer belt 6 is driven. It removes the residual toner particles, that is, the toner particles which were not transferred onto a recording medium P in the secondary transfer station T' and remained on the intermediary transfer belt 6.

The fixing means 9 (fixing device) has two rollers: a fixing roller 91 and a pressure roller 92. It fixes the toner images to the recording medium P after they are transferred onto the recording medium P.

Next, the operation of the image forming apparatus 200 structured as described above will be described. First, the peripheral surface of the photoconductive drum 1 is uniformly charged by applying charge bias to the charge roller 2 while rotationally driving the photoconductive drum 1 in the direction indicated by the arrow mark in the drawing. Next, the photoconductive drum 1 is exposed by the exposing means 3 in accordance with the image formation data of the first color component, for example, yellow (Y) color component, forming an electrostatic latent image corresponding to the yellow component of an intended image. At this point of the image forming operation, the developing device rotary 4 is rotated to move the yellow component developing device 4Y to the position at which the yellow component developing device 4Y, which contains yellow toner as developer, opposes the photoconductive drum 1. Then, a compound bias (development bias), which normally is a combination of DC and AC voltages, is applied to the developer bearing member (development roller) of the yellow component developing device 4Y to adhere the yellow toner to the electrostatic image on the photoconductive drum 1. As a result, a toner image is made up of yellow toner, on the peripheral surface of the photoconductive drum 1. Then, the yellow toner image on the photoconductive drum 1 is transferred onto the intermediary transfer belt 6 by applying the primary transfer bias to the primary transfer roller 5.

Similarly, the toner images corresponding to magenta (M), cyan (C), and black (K) color components, respectively, are sequentially formed on the photoconductive drum 1, and are transferred in layers onto the intermediary transfer belt 6. As a result, four toner images different in color are placed in layers on the intermediary transfer belt 6.

Meanwhile, the recording medium P stored in a cassette 12 as a recording medium storing portion are consecutively supplied into the image forming apparatus 200 while being separated from the other recording medium P. Each recording medium P is conveyed to the secondary transfer station T' by a conveyance roller pair 14 and a registration roller pair 15 in synchronism with the movement of the four color toner images on the intermediary transfer belt 6.

In the secondary transfer station T', the four color toner images layered on the intermediary transfer belt 6 are transferred all at once, by applying secondary transfer bias to the secondary transfer roller 8, onto the recording medium P which is being fed into the secondary transfer station T' with a predetermined timing.

After the transfer, the toner images on the recording medium P are fixed by the fixing device 9; toner images on the recording medium P are turned into a permanent full-color image. Thereafter, the recording medium P is discharged from the image forming apparatus by a combination of a conveyance roller pair 16, a discharge roller pair 17, and the like.

Prior to the employment of an intermediary transfer type image formation process such as the above described one, a multi-transfer type image formation process had been employed, in which a plurality of toner images were sequentially transferred in layers onto a recording medium kept electrostatically adhered to a recording medium conveying means such as a conveyer belt. In the case of this type of transferring method in which a plurality of toner images are transferred in layers onto a recording medium, image quality is largely dependent upon recording medium properties, for example, the size, thickness, and surface roughness, as well as recording medium uniformity which is affected by the presence of gaps in the recording medium.

In comparison, according to the intermediary transfer type image formation process, the toner images are layered on an intermediary transferring member, the base layer of which is formed of resin, that is, material with uniform consistency. Therefore, the problem that image quality is affected by the recording medium properties can be avoided to improve image quality.

As for the intermediary transferring member, there are two essential types: a drum type and a belt type. In consideration of the reduction of image forming apparatus size and spacial efficiency, the selection of the belt type intermediary transfer member is preferable, since it affords more latitude in the mechanical design of an image forming apparatus.

However, in the case of an intermediary transfer type image formation process which employs an intermediary transfer belt, the material for the intermediary transfer belt onto which toner images are transferred in the primary transfer process is required to be uniform in consistency.

For example, the fact that the surface of an intermediary transfer belt is rough means that there are a large number of high peaks and low valleys on the surface of the intermediary transfer belt as shown in FIG. 11(*a*). With the presence of such peaks and valleys, it is possible that the photoconductive drum and primary transfer roller pinch the intermediary transfer belt as shown in FIG. 11(*b*); in other words, the intermediary transfer belt fails to uniformly contact the photoconductive drum and transfer roller, creating an unsatisfactory transfer electric field.

As an unsatisfactory transfer electric field is created, the efficiency with which image forming dots are transferred reduces. For example, in the area of the intermediary transfer belt, shown in FIG. 12, across which an unsatisfactory transfer electrical field is created, the dot transfer efficiency is lower. If the location of such an area coincides with a given portion of the solid portion of of an image, it is possible that this portion will be developed into an area (hatched portion), shown in FIG. 13(*a*), the density of which is lower than the intended density, that is, the density of the surrounding area. Further, if the location of such an area coincides a given halftone portion of an image, when forming the given halftone portion of an image, with the use of small dots in accordance with the gradation method based on dot area ratio, some of the small dots will not be transferred at all, resulting in an image defect, that is, an unintended white spot, as shown in FIG. 13(*b*).

SUMMARY OF THE INVENTION

The present invention was made in consideration of the above described issues, and its primary object is to provide an image forming apparatus, in which the intermediary transferring member uniformly contacts both the image bearing member and transferring member, preventing therefore the occurrence of image defects traceable to the surface configuration of the intermediary transferring member, so that high quality images can be formed.

A preferable embodiment of an image forming apparatus for accomplishing the above object comprises:

an image bearing member for bearing an image made up of developer;

an image forming means for forming a developer image, on said image bearing member;

an intermediary transferring member onto which the developer image on said image bearing member is transferred;

a primary transferring member, which is disposed at a position where it opposes said image bearing member, pressing said intermediary transferring member upon said image bearing member, with said intermediary transferring member interposed between the said primary transferring member and image bearing member, and transfers the developer image on said image bearing member onto said intermediary transferring member as voltage is applied to the primary transferring member; and a secondary transferring member for transferring the developer image on said intermediary transferring member onto a recording medium, wherein the following relation is satisfied:

$$\theta a < 2.355 \times (P+11.4)/(R+94.2) - 0.0174 \times Rmax$$

in which

Rmax ($\mu$m) is the maximum value of the height of the projection, which represents the surface roughness of the said intermediary transferring member onto which a developer image is transferred;

θa (*) is an average inclination angle which also represents the surface roughness of the said intermediary transferring member onto which a developer image is transferred;

P (N) is the amount of the pressure applied to keep said transferring member pressed upon said intermediary transferring member; and R (*) is the hardness, in Asker C scale, of said transferring member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 6 is a table, which shows the results of the experiments, in which a plurality of primary transferring members different in hardness were tested.

FIG. 9 is a graph, which shows the results of the experiments, in which the pressured applied to keep the primary transferring member pressed against the photoconductive drum was varied.

DESCRIPTION OF THE PREFERRED EMBODIMENTS

Hereinafter, the image forming apparatus in accordance with the present invention will be described in more detail with reference to the appended drawings.

Figure 1:
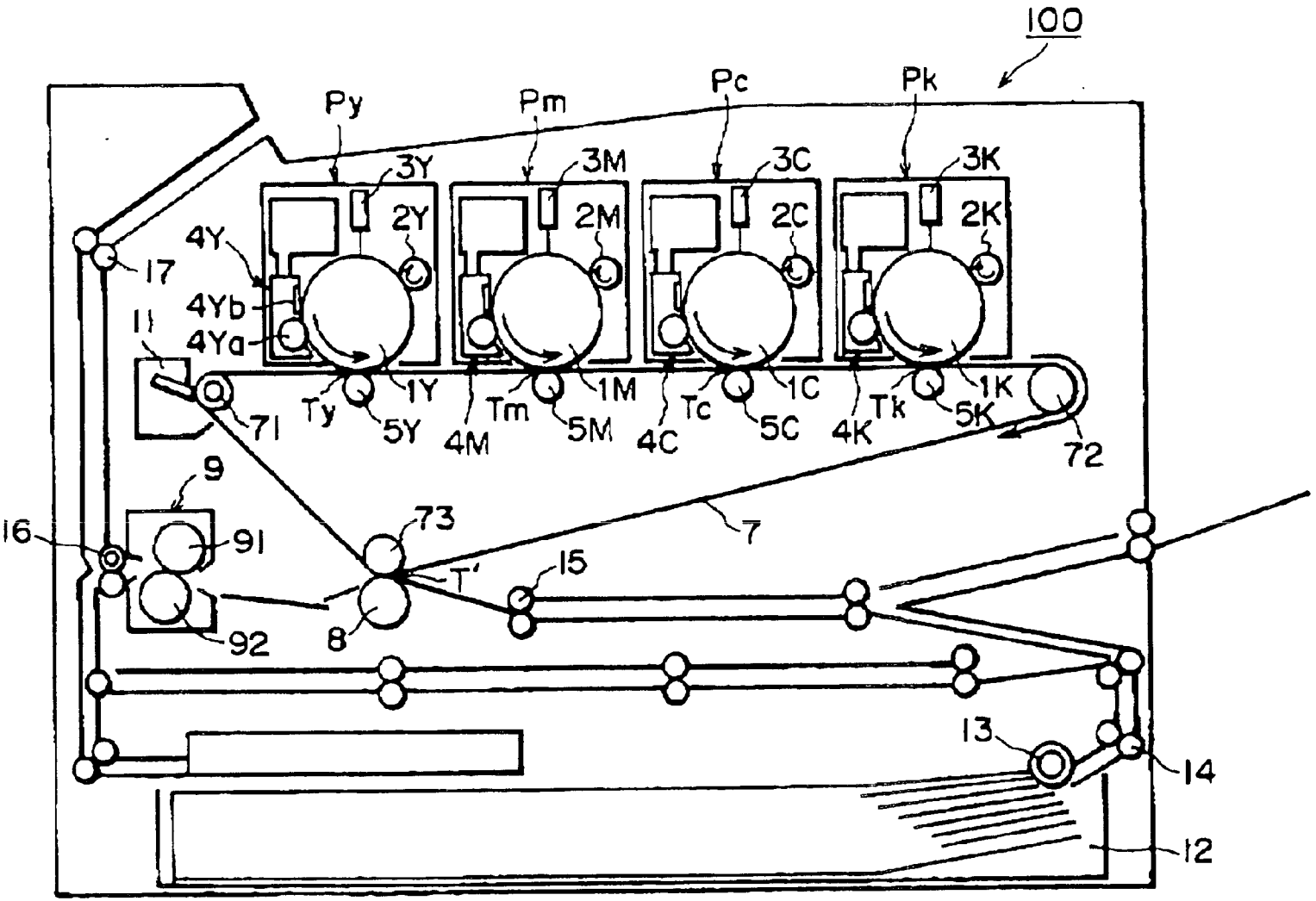
FIG. 1 is a sectional view of an example of an image forming apparatus to which the present invention is applicable, for showing the general structure thereof.

Referring to FIG. 1, an example of an image forming apparatus to which the present invention is applicable will be described. The image forming apparatus 100 in FIG. 1 is an electrophotographic color image forming apparatus (color laser printer).

The image forming apparatus 100 shown in FIG. 1 comprises image formation units Py, Pm, Pc, and Pk, as means for forming images corresponding to yellow (Y), magenta (M), cyan (C), and black (K) color components, which are disposed along the flat portion of the intermediary transfer belt 7, in the listed order in terms of the moving direction of the intermediary transfer belt 7. Since all the image formation units are basically the same in structure, their details will be described with reference to the image formation unit Py, the unit for forming the image corresponding to the yellow color component, which hereinafter will be referred to as the yellow image formation unit.

The yellow image formation unit Py has an electrophotographic photoconductive member 1Y, as an image bearing member, in the form of a drum (photoconductive drum), which comprises an aluminum cylinder, as a base layer, with a diameter of 30 mm, and functional layers: a photoconductive layer, a charge transfer layer, and a surface protection layer, which are layered on the base layer. The surface protection layer is formed of photo-curable acrylic resin in which microscopic particles of tin oxide were dispersed. As electrical charge is injected into the photoconductive drum 1Y, the peripheral surface of the photoconductive drum 1Y is uniformly charged.

The yellow image formation unit py is provided with a charge roller 2Y, which is a charge injection type charging device as a charging means. As a charge bias, which is a combination of a DC bias of −700 V and an AC voltage of 1.5 kVp-p is applied to the charge roller 2Y, the peripheral surface of the photoconductive drum 1Y is uniformly charged to −700 V.

Above the photoconductive drum 1Y, a laser beam scanner 3Y as an image exposing means is disposed, which scans the uniformly charged peripheral surface of the photoconductive drum 1 with a beam of light modulated with image formation data, forcing an electrostatic latent image corresponding to the yellow color component of an intended image.

The electrostatic latent image on the photoconductive drum 1Y is developed by the developing means which employs toner as developer. More specifically, the developing means 4Y is a non-magnetic, single-component, and contact developing device, and is provided with a development roller 4Ya as a developer bearing member, and a regulation blade 4Yb as a developer amount regulating member. It contains nonmagnetic single-component yellow toner as developer. The development roller 4Ya, which is supplied with the yellow toner, is placed in contact with the photoconductive drum 1Y, with the application of light pressure, in the development station. It is rotated in the same direction as the photoconductive drum 1Y, with the provision of a peripheral velocity difference between the development roller 4Ya and photoconductive drum 1. As the yellow toner is conveyed to the development station by the development roller 4Ya, it is adhered to the electrostatic latent image on the photoconductive drum 1Y by applying a development bias of −300 V to the development roller 4Ya. As a result, a visible image (image made up of yellow toner, or yellow toner image) is formed on the photoconductive drum 1Y.

The intermediary transfer belt 7 as an intermediary transferring member is suspended, being stretched, around a driving roller 71, a tension roller 72, and a follower roller 73, and is moved (rotationally driven) in the direction indicated by an arrow mark in the drawing at 117 [mm/sec], in contact with the photoconductive drum 1Y. As the yellow toner image reaches the primary transfer station Ty, it is transferred onto the intermediary transfer belt 7 by the primary transfer roller 7Y as the primary transferring means which is kept pressed against the photoconductive drum ly with the interposition of the intermediary transfer belt 7 between the primary transfer roller 5Y and intermediary transfer belt 7. The primary transfer roller 5Y is a roller formed by foaming the electrical conductive material with an electrical resistance of approximately $10^5$ ohm.cm, which is concocted by dispersing carbon black in EPDN rubber. To this primary transfer roller 5Y, a primary transfer bias of approximately 500 V, for example, is applied under constant voltage control.

As the intermediary transfer belt 7 is moved, an image forming operation similar to the above described one is carried out by the image formation units Pm, Pc, and Pk for the magenta (M), cyan (C), and black (K) color components, respectively. As a result, four toner images, that is, yellow, magenta, cyan, and black color toner images, are placed in layers on the intermediary transfer belt 7. The four color toner images are conveyed by the movement of the intermediary transfer belt 7 to the secondary transfer station T', in which they are transferred all at once by the secondary transfer roller 8 as the secondary transfer roller, onto a recording medium P conveyed to the secondary transfer station T' with a predetermined timing. The secondary transfer roller 8 is made up of foamed rubber similar to the foamed rubber of the primary transfer roller, except that the electrical resistance of the second transfer roller 8 has been adjusted to approximately $10^8$ ohm.cm. To this secondary transfer roller 8, a secondary transfer bias of 3 kV, for example, is applied under constant voltage control.

The recording mediums p are stored in a cassette 12 as a recording medium storing portion, and are supplied into the image forming apparatus by a pickup roller 13 while being separated from the other recording medium P. Each recording medium P is conveyed to the secondary transfer station T' by a conveyance roller pair 14 and a registration roller pair 15 in synchronism with the movement of the four color toner images on the intermediary transfer belt 7.

After the transfer, the toner images an the recording medium P are fixed by the fixing device 9; toner images on the recording medium P are turned into a permanent full-color image, for example. The fixing device 9 has a fixing roller 91 and pressure roller 92 equipped with heating means, and fixes the unfixed toner images on the recording medium P by applying heat and pressure to the recording medium P and the toner images thereon.

Thereafter, the recording medium P is discharged from the image forming apparatus by a combination of a conveyance roller pair 16, a discharge roller pair 17, and the like.

On the downstream side of the secondary transfer station T' in terms of the direction in which the intermediary transfer belt 7 is driven, a cleaning blade 11 as the means for cleaning the intermediary transfer belt 7 is disposed to remove the transfer residual toner particles, that is, the toner particles remaining on the intermediary transfer belt 7 without being transferred onto the recording medium P, in the secondary transfer station T'. Further, the transfer residual toner particles remaining on each of the photoconductive drums 1Y–1K after the transfer of the corresponding images are removed by cleaning means. In the case of a cleaner-less image forming apparatus, the transfer residual toner particles on the photoconductive drums 1Y–1K are recovered by developing devices 4Y–4K, respectively.

The proper levels for the charge voltage, development bias, primary transfer bias, and secondary transfer bias are dependent upon external factors such as ambient temperature and humidity, type of the recording medium P, and the like, and are not limited to the above described values.

As for the material for the intermediary, transfer belt 7, resinous material such as polyimide, ethylene-tetrafluoroethylene copolymer (ETFE), polyvinylidene fluoride (PVDF), polycarbonate (PC), polyethylene-terephthalate (PET) can be used.

In this embodiment, the intermediary transfer belt 7 was manufactured using polyimide resin as the base material, and its thickness was 80 $\mu$m. In particular, when using polyimide, which was used in this embodiment, as the material for the intermediary transfer belt 7, the intermediary transfer belt 7 can be manufactured using the following method: polyamide acid solution is coated on the external or internal surface of a cylindrical metallic mold using the immersion coating method, the centrifugal coating method, or the like coating method, is dried into film, and is heated to turn the polyimide acid into imide. Needless to say, the present invention does not limit at all the choice the method for manufacturing the intermediary transferring member. The configuration (roughness) of the surface of the intermediary transfer belt 7 onto which an image is transferred can be adjusted by the surface roughness of the metallic mold used for forming the intermediary transfer belt, temperature at which the aforementioned film of polyamide is heated, or the like.

The electrical resistance of the intermediary transfer belt 7 in this embodiment was adjusted by the dispersion of carbon black. The volumetric resistivity of the intermediary transfer belt 7 is desired to be in a range of $10–10^{12}$ ohm.cm, and the surface resistivity of the intermediary transfer belt 7 is desired to be in a range of $10^{12}–10^{14}$ ohm.□. When the volumetric resistivity of the intermediary transfer belt 7 is no less than $10^{12}$ ohm.cm, it is possible that as the intermediary transfer belt 7 is continuously driven, it will be charged up and cause image defects. In order to prevent this problem, a discharging mechanism is necessary, which leads to structural complication and cost increase. On the other hand, when the volumetric resistivity of the intermediary transfer belt 7 is no fore than $10^6$ ohm.cm, it is possible, for example, that the bias applied in a given primary transfer station among the primary transfer stations Ty–Tk will unintendedly flow as far as the adjacent primary transfer stations, causing the image defects traceable to an insufficient amount of transfer bias.

Further, an intermediary transfer belt 7 with a high surface resistivity of no less than $10^{14}$ ohm.□ is high in charge retention capacity. Therefore, it is possible that it will trigger electrical discharge, causing image defects, when a recording medium P separates from the intermediary transfer belt 7 after passing the secondary transfer station T'. On the other hand, in the case of an intermediary transfer belt 7 with a surface resistivity of no more than $10^8$ ohm.□, it is possible that an image defect of so-called "scattering", that is, the image defect that toner particles scatter to the unintended areas, when a dot image, for example, is formed, will occur. This problem is an phenomenon that as the presence of the bottom toner layer causes the transfer electric field to go around the bottom toner layer to reach out for the area with no toner, the toner particles forming the edge portion of a dot scatter. This phenomenon can be avoided by setting the bottom limit of the surface resistivity of the intermediary transfer belt 7 to $10^8$ ohm.□.

The transfer residual toner particles remaining on the intermediary transfer belt 7 without being transferred onto the recording medium P, in the secondary transfer station T', are removed by placing the cleaning means such as the cleaning blade 11 in contact with the intermediary transfer belt 7. Therefore, the intermediary transfer belt 7 is desired to be fabricated so that the ten-point average roughness Rz (in accordance with JIS B0601) becomes no less than 0.05

μm and no more than 10 μm, preferably, no less than 2 μm and no more than 10 μm. In the case of a smoothly surfaced intermediary transfer belt, that is, an intermediary transfer belt having a ten-point surface roughness Rz of no more than 0.05 pa, the problem that the cleaning edge of the cleaning blade 11 is bent by the intermediary transfer belt 7 in the direction in which the intermediary transfer belt 7 is moved, occurs, in particular, when the ambient temperature and humidity are high. On the other hand, in the case of an intermediary transfer belt having a ten-point surface roughness Rz of no less than 10 μm, it is possible that the toner particles will be embedded in the recesses of the surface of the intermediary transfer belt, preventing the intermediary transfer belt from being properly cleaned.

Hereinafter, the experiments in which the aforementioned image forming apparatus 100 was equipped with each of three intermediary transfer belts (I, II and III) different in surface properties, to studies the requirements for preventing the image defects traceable to the surface properties of the intermediary transfer belt, will be described.

Figure 2:
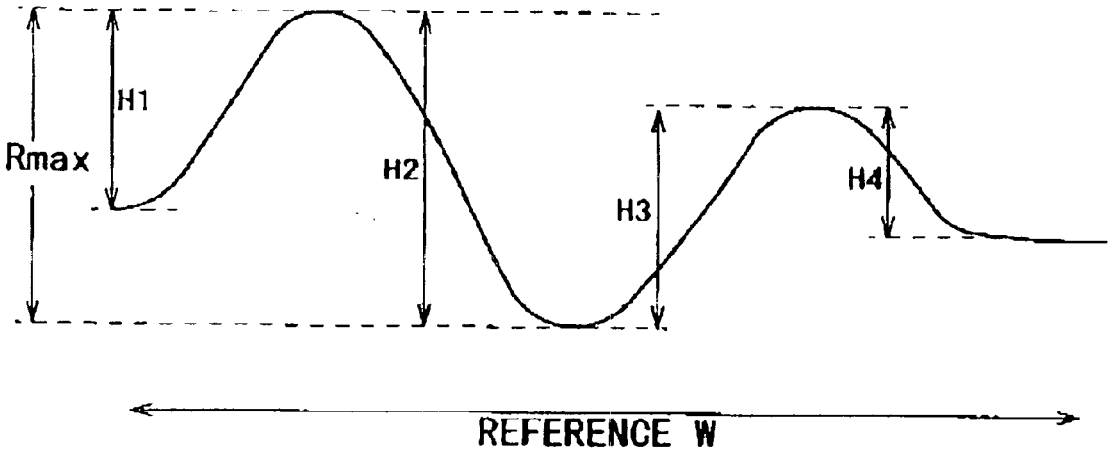
FIG. 2 is a graph for describing the average inclination angle θa which represents the configuration of the surface of the intermediary transferring member, onto which a developer image is transferred.

As for the index for representing the configuration of the surface of the intermediary transfer belt 7 onto which a toner image is transferred, the maximum height Rmax (in accordance with JISB0601) and average inclination angle ea, shown in FIG. 2, were measured. The method for measuring the maximum height Rmax, average inclination angle θa, volumetric resistivity, and sheet resistivity, will be described later.

The test conditions were set as follows:

The specifications of the intermediary transfer belt in this embodiment were:

material: semiconductive polyimide resin;

thickness: 80 μm;

volumetric resistivity: $10^9$ ohm.cm;

surface resistivity: $10^{12}$ ohm.□; and elastic modulus: 5 Gpa.

The specifications of the primary transfer roller were:

material: semiconductive urethane sponge;

external diameter: 16 mm (metallic core diameter: 8 mm);

electrical resistance value: $10^6$ ohm (when 50 V was applied);

hardness: 10' (Asker C hardness scale); and load: 49 N.

The amount of the pressure applied to keep the primary transfer roller pressed against the photoconductive drum (with the interposition of intermediary transfer belt) was 7.8 N.

When the image forming apparatus 100 with the above described specifications was equipped with each of the three intermediary transfer belts (I, II, and III), and ten copies, the entirety of which were covered with a halftone image, were outputted using recording papers CLC80 (product of Nippon Seishi Co., Ltd. with a basis weight of 80 g/$m^2$) of A3 size (in order to form a toner image across the entirety of the intermediary transfer belt surface), it was confirmed that a certain number of image defects occurred across each recording paper, and that the locations of the image defects coincided with specific portions of the intermediary transfer belt (since ten copies were outputted in succession, it was possible to confirm that the occurrence of the image defects coincided with the rotational cycle of the intermediary transfer belt).

In the case of the intermediary transfer belts I and II, the presence of six and five projections, respectively, was visually confirmed. In the case of the intermediary transfer belt III, the presence of six projections was visually confirmed. The locations of the projections were marked with the use of tracing papers, and were compared to the locations of the image defects on the copies. Further, the marked projections were measured in the maximum height Rmax and average inclination angle θa.

Then, the images formed using these belts were evaluated; the state of the portions of the images corresponding to the marked locations were visually examined to determine the levels of the image defects.

Figure 3:
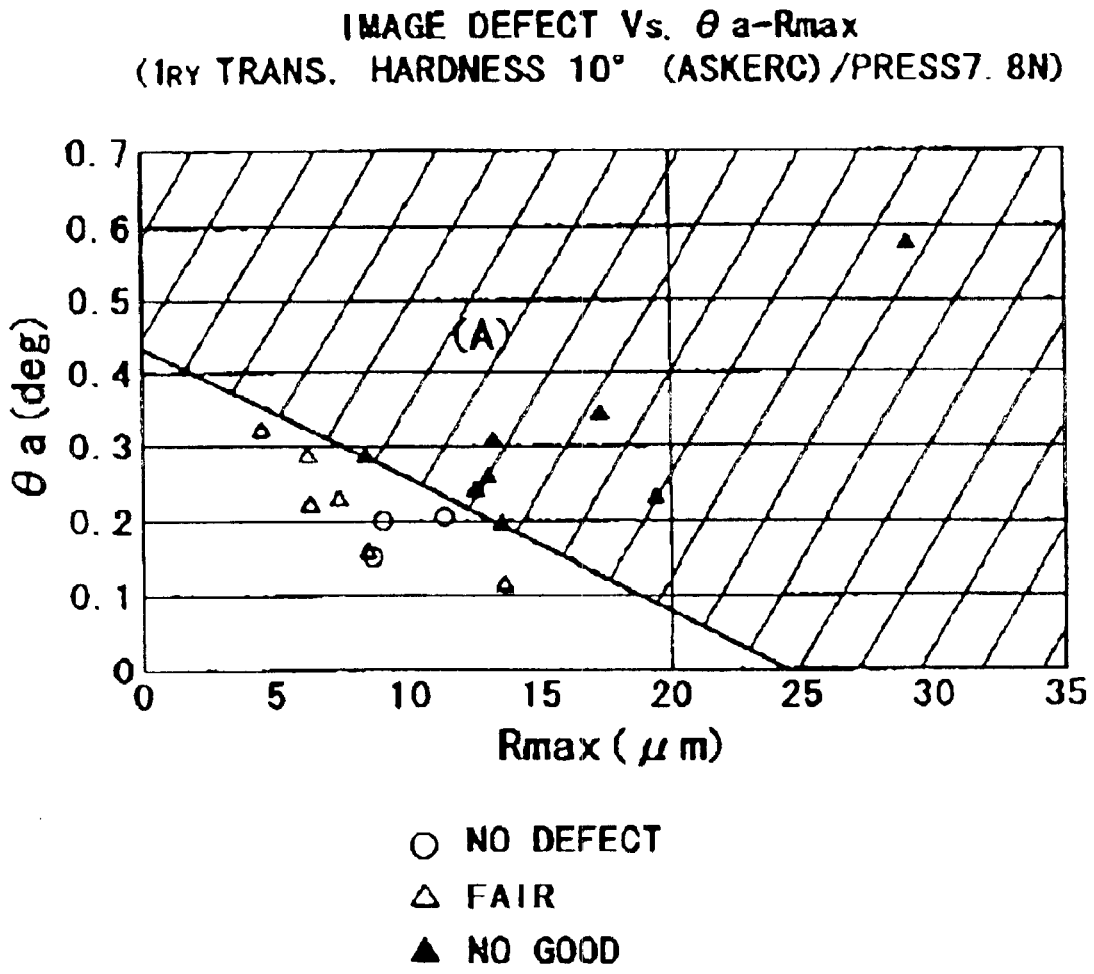
FIG. 3 is a graph, which shows the results of the experiments.

The relationship between the image defect level, and surface roughness indices θa and Rmax of the intermediary transfer belt is shown in FIG. 3.

In FIG. 3, o indicates that no image defect occurred; Δ indicates that image defects of a tolerable level, that is, the image defect which did not create problems in practical terms, occurred; and ▲ indicates that image defects of an intolerable level occurred. The image defect detected as an unintended white spot in this embodiment was no smaller than approximately 200 μm in diameter. However, the appearance of the image defect is sometimes affected by the maximum dot diameter of an image, image processing method, or the like.

Incidentally, it has been known that unless the surface roughness of an intermediary transfer belt is made no more than a certain level, image defects occur.

For example, Japanese Laid-open Patent Application 8-160763 discloses that the sum of the maximum height Rmax of the first image bearing member (photoconductive drum) and the maximum height Rmax of the intermediary transferring member should be no more than 20 μm.

Further, in Japanese Laid-open Patent Application 7-271201, it is disclosed that the ten-point average roughness Rz, which is virtually the same as the toner particle size, should be no less than 5 μm and no more than 20 μm.

As is evident from FIG. 3, in the above described experiments, the maximum height Rmax was 29.00 μm (θa was 0.5770*), and a projection, the maximum height of which exceeded 20 μm, caused image defects. From the above results and the further studies made by the inventors of the present invention, it became evident that the roughness of the surface of the intermediary transferring member onto which an image was transferred was desired to be no more than 20 μm, at least in terms of the maximum height Rmax.

On the other hand, it is stated in Japanese Laid-open Patent Application 2000-155476 that in view of the fact that if the roughness of the surface of an intermediary transferring member onto which an image is transferred is large, toner particles settle in the recesses of the intermediary transferring member surface, which adversely affects the transfer, the roughness of the surface of an intermediary transferring member onto which an image is transferred should be made to be no more than 0.35 μm in terms of the centerline average roughness Ra, and to be no more than 5 μm in the maximum height Rmax.

It is evident, however, from the results of the above described experiments that even if the maximum height Rmax is 13.51 μm (θa is 0.118*), for example, in other words, the height (measured value of height of projection on intermediary transfer belt (II)) of a projection, which effects surface roughness, is smaller than the toner particle size in this embodiment, the projection still causes an image defect, although the level of the defect is not high enough to cause a problem in practical terms.

Based on the above described results, the inventors of the present invention carried out a large number of additional experiments and studies, discovering that in order to prevent the occurrence of image defects, it is necessary to regulate the index θa, which indicates the shape (degree of expansion) of a projection on the intermediary transferring member surface, in addition to the maximum height Rmax of the projection.

The studies made, with reference to FIG. 3, regarding the conditions, under which image defects occurred, revealed that the hatched area (A) in FIG. 3 represents the conditions under which image defects occurred. The borderline of this area (A) can be approximately expressed by a linear function of Rmax and θa.

More specifically, at a given point outside the hatched area (A) in FIG. 3, that is, where $\theta a<0.434-0.0174\times Rmax$, an image defect does not occur, or an image defect, the level of which is low enough to create no practical problem, occurs.

As described above, in the case of the image forming apparatus 100 used in the above described experiments and studies, the occurrence of the image defects, such as the unintended white spot in a halftone area of an image, traceable to the quality of the intermediary transfer belt 7, can be avoided by satisfying the following requirement:

Rmax (maximum height of projection on intermediary transfer belt 7)≦20 μm, and θa (average inclination angle)$<0.434-0.0174\times Rmax$.

In carrying out the further studies of the relationship between the surface configuration of an intermediary transferring member and image defect, the inventor of the present invention paid attention to the factors which affected the state in which an intermediary transferring member and a photoconductive drum were kept pressed against each other, more specifically, the hardness of the primary transfer roller and the conditions under which the primary transfer roller was kept pressed against the photoconductive drum, and carried out the following experiments.

First, the amount of the pressure applied to the first transfer roller as a transferring member was kept at 7.8 N, and the hardness of the primary transfer roller was set to two different values (35' and 20').

Figure 4:
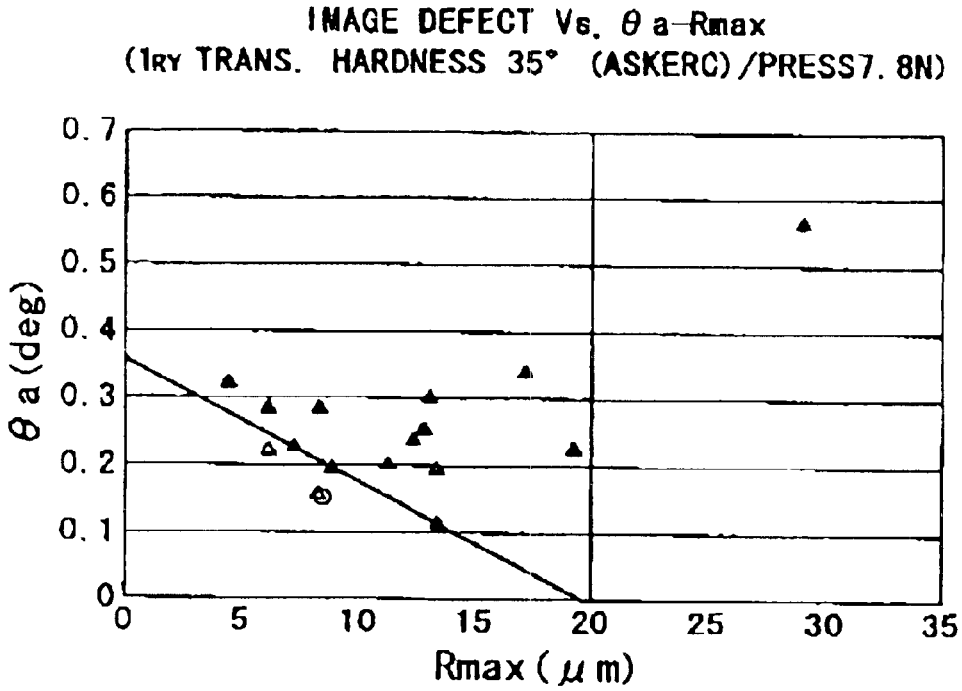
FIG. 4 is a graph, which shows the results of the experiments.
Figure 5:
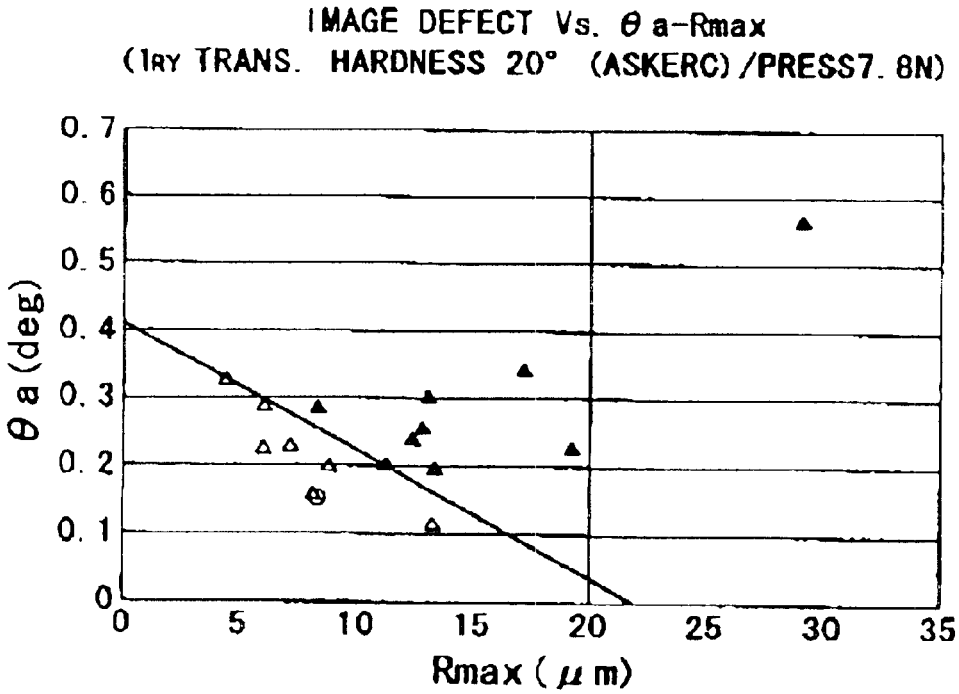
FIG. 5 is a graph, which shows the results of the experiments.

FIG. 4 shows the results obtained when the hardness was 35', and FIG. 5 shows the results obtained when the hardness was 20'.

FIG. 6 to a table which summarizes the results of the experiments.

It is evident from these results that reducing the hardness of the primary transfer roller improves the state in which the primary transfer roller and photoconductive drum are kept pressed against each other, preventing the occurrence of gaps between the primary transfer roller and intermediary transfer belt, preventing therefore the occurrence of abnormal electrical discharge, and preventing therefore the occurrence of image defects.

It also became evident from the results of the experiments that as the hardness was varied, the border region of the graph affected "B" in the expression made up of the linear functions of θa and Rmax: $\theta a=B-0.0174\times Rmax$. In other words, reducing the hardness increases the value of B, widening the area in the graphs in which the intermediary transferring member is satisfactorily usable.

However, in the case of a transfer roller formed of foamed material, in order to reduce the hardness of the transfer roller to no more than 5', there is no other way, but to increase the cell diameter of the foamed material, or sponge, which in turn invites the problems that the transfer roller is deteriorated by the electrical discharge within the cells, and/or the transfer roller surface is deteriorated by the rubbing between the sponge surface and intermediary transferring member, which is undesirable.

Figure 7:
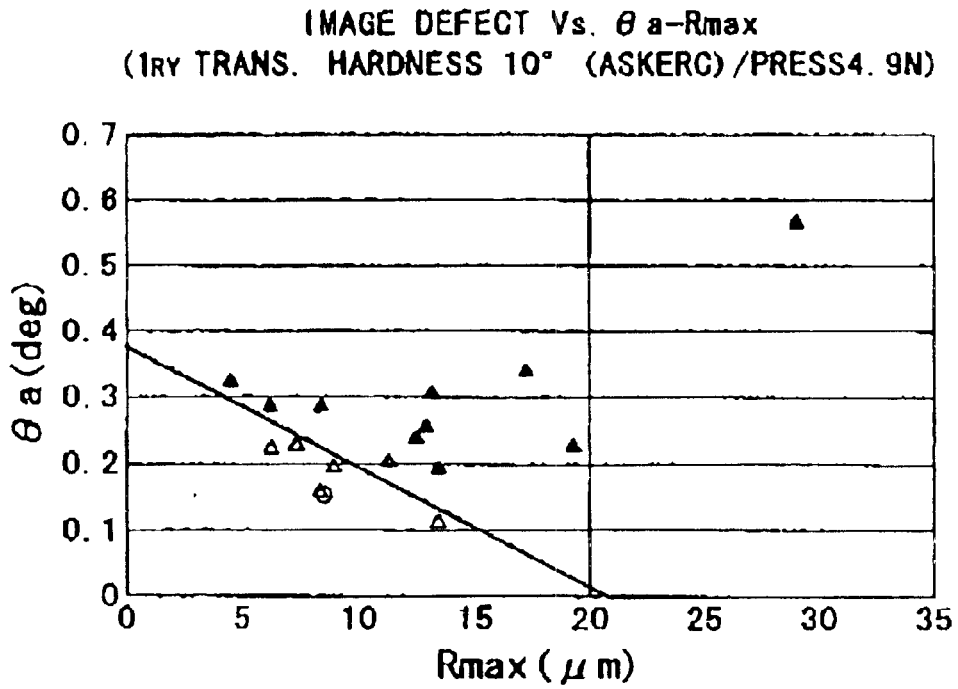
FIG. 7 is a graph, which shows the results of the experiments.
Figure 8:
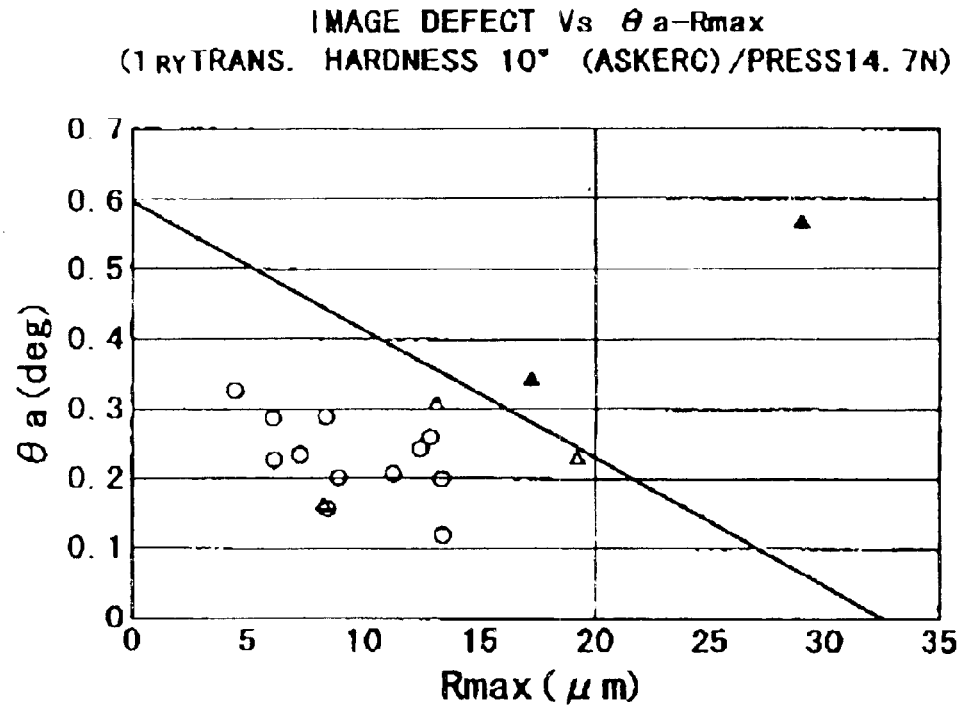
FIG. 8 is a graph, which shows the results of the experiments.

Further, experiments were carried out regarding the relationship between the amount of the pressure by which the primary transfer roller is kept pressed against the photoconductive drum, and image defects. In the experiments, which will be described next, the hardness of the primary transfer roller 1 was kept at 10°, and image quality was evaluated while applying 4.9 N and 14.7 N to keep the primary transfer roller pressed against the photoconductive drum. The results of the evaluation when 4.9 N was applied are shown in FIG. 7, and those when 14.7 N wan applied are shown in FIG. 8.

FIG. 9 is a table which summarizes the results of the above described experiments.

It is evident from the above results that the occurrence of image defects can be prevented by increasing the amount of the pressure applied to keep the primary transfer roller pressed against the photoconductive drum, because increasing the amount of the pressure applied to keep the primary transfer roller pressed against the photoconductive drum improves the state in which the intermediary transferring member and photoconductive drum are kept in contact with each other, and the state in which the intermediary transferring member and primary transfer roller are kept in contact with each other.

It also became evident that as the applied pressure was varied, the border region of the graph affected "B" in the expression made up of the linear functions of θa and Rmax: $\theta a=B-0.0174\times Rmax$. In other words, increasing the applied pressure increases the value of D, widening the area in the graphs in which the intermediary transferring or is satisfactorily usable.

However, excessively increasing the pressure applied to keep the primary transfer roller and photoconductive drum pressed against each other sometimes causes a problem that the photoconductive drum is damaged. Therefore, the amount of the pressure must be balanced against this problem.

The following became evident from the studies of the results of the above described experiments:

(1) It is effective to define the state of the surface of an intermediary transferring member, which does not cause image defects, with the use of Rmax and θa. The borderline of the area in which an intermediary transferring member is satisfactorily usable can be expressed in the form of a mathematical expression: $\theta a=B-0.0174\times Rmax$ (B is coefficient).

(2) The above coefficient B is defined by the hardness of the primary transferring member and the pressure applied to keep the primary transferring member pressed against the photoconductive drum.

Next, the above described coefficient B, which is the function of the above described hardness and pressure, will be further discussed. As is suggested by the results of the above described experiments, the coefficient B changes in the manner of a linear function, that is, the lower the level of the hardness of the primary transferring member, as well as the higher the pressure applied to keep the primary transferring member pressed against the photoconductive drum, the greater the coefficient B. Therefore, it is possible to think that the value of the coefficient B can be obtained from the following mathematical expression:

$$B=(\alpha\times(P+\gamma)/(R+\beta)\ (\alpha,\ \beta \text{ and } \gamma \text{ are coefficients})$$

wherein

R(*): hardness in Asker C scale; and

P (N): pressure.

To obtain the values of α, β and γ using a ternary linear equation, by substituting the known values for B, P, R in the plurality of mathematical expressions of the borderlines for θa and Rmax (FIGS. 3, 4, 5, 7 and 8);

α=2.355; β=94.2; and γ=11.4.

Thus, the value of the coefficient B can be obtained from the following mathematical expression:

$$B=2.355\times(P+11.4)/(R+94.2).$$

Therefore, the expression representing the borderline of the area, in which the intermediary transfer member in satisfactorily usable, becomes as follows:

$$\theta a=2.355\times(P+11.4)/(R+94.2)-0.0174\times Rmax.$$

From these results, the relation necessary between the indices θa and Rmax, which represent the surface roughness of an intermediary transferring member, to prevent the occurrence of image defects, becomes the following expression:

$$\theta a=2.355\times(P+11.4)/(R+94-2)-0.0174\times Rmax.$$

P: pressure applied to keep transferring member pressed against image bearing member;

R: hardness (°) of transferring member in Asker C scale.

Regarding the smallest value for θa, in the experiments carried out to test the present invention, when the value of θa was no more than 0.005, there were no gaps for air to escape in the adjacencies of the primary transfer nip, causing the image to become slightly blurred as if it were slightly shifted downstream as it was transferred onto the recording medium P, or forming an excessively large contact nip between the photoconductive drum and intermediary transfer belt, which in turn caused the so-called filming phenomenon, that is, the phenomenon that the toner particles of a given portion of the image become adhered to the belt surface, failing to be transferred onto the recording medium P, which results in a defective image with an unintended white spot, the location of which coincides with the location of the portion of the belt surface to which the toner particles adhered. Therefore, the value of the index θa is desired to be no less than 0.005, preferably, no less then 0.001. In other words, the index θa is desired to satisfy the following mathematical expression:

$$0.005\leqq\theta a<2.355\times(P+11.4)/(R+94.2)-0.0174\times Rmax$$

wherein Rmax is no more than 20 μm.

Meeting the above conditions makes it possible to reduce the image defect level to a point where the defects are insignificant in practical terms. In order to prevent the occurrence of even the image defects, the level of which causes no practical problem, it is preferred that, in addition to the above mathematical expression, the following expressions are also satisfied:

Rmax≦12 (μm), and θa<0.24 (*).

In other words, these mathematical expressions together define the surface configuration of an intermediary transferring member which causes virtually no image defects.

Hereafter, the definitions and measurements of the indices θa and Rmax, surface resistivity, and volumetric resistivity, will be described.

Referring to FIG. 2, the average inclination angle θa represents the value, expressed in angles, obtained by dividing the sum of the relative heights (H1, H2, . . . ) within a referential range W by the length of the referential range W. In other words, provided that the length of the referential range W remains the same, the greater the average inclination angle θa, the steeper the peaks and valleys of the surface.

$\theta a=\tan^{-1}[EHn/W]$

W: length of referential range

Hn (n: integer): differences between adjacent highest and lowest points within referential range.

Further, since the index θa is such a value that is obtained by detecting the highest points of all the peaks, and the lowest points of all the valleys, with a referential range, and adding all the differences between the adjacent highest and lowest points, the index θa is characterized in that the rougher the surface, and also, the greater the number of the peaks and valleys, the greater the value of the index θa. In other words, the fact that the value of the average inclination angle θa of the surface of an intermediary transferring member is small means that the number of the peaks and valleys of the surface of the intermediary transferring member is small, and also that the small number of peaks and valleys are gentle, which in turns means that the intermediary transferring member is superior in surface properties.

As described above, according to the present invention, the properties of the surface of an intermediary transferring member are defined by two indices: the maximum height Rmax, or the height of the highest peak relative to the lowest point of the deepest valley of the surface of the intermediary transferring member, and the average inclination angle θa, which indicates the degree of the expansion of the peaks and valleys, which cannot be expressed by the maximum height Rmax alone.

(Measurement Method)

The characteristics of the intermediary transfer belts (I, II, and III) in the above described experiments, that is, the maximum height Rmax, average inclination angle θa, volumetric resistivity, and surface resistivity, were measured using the following method:

(1) Maximum Height Rmax and Average Inclination Angle θa

The maximum height Rmax and average inclination angle θa were measured using Surfcorder SE-3400 (Kosaka Lab., Co., Ltd.) and a filter 2CR, with the evaluation length (referential range length), conveyance velocity, and cutoff λc set to 2.5 mm, 0.5 mm, and 0.8 mm, respectively. They were measured three times, and the average was used as their values.

(2) Surface Resistivity and Volumetric Resistivity

The surface resistivity was measured using a digital ultrahigh resistance meter R8340A (product of Advantest Co., Ltd., and is used with probe R12702A by the same company), after discharging the intermediary transferring member for 10 seconds, and applying 100 V for 10 seconds, in the ambience in which temperature and relative humidity were 23° C. and 50%, respectively. It was measured at six points on each intermediary transferring member.

As described above, according to the present invention, not only are the properties of the intermediary transfer belt 7 defined in terms of the maximum height Rmax, but also in terms of average inclination angle θa. Therefore, the occurrence of the image defects traceable to the surface configuration of the intermediary transfer belt 7 can be avoided, making it possible to form high quality is images.

Figure 10:
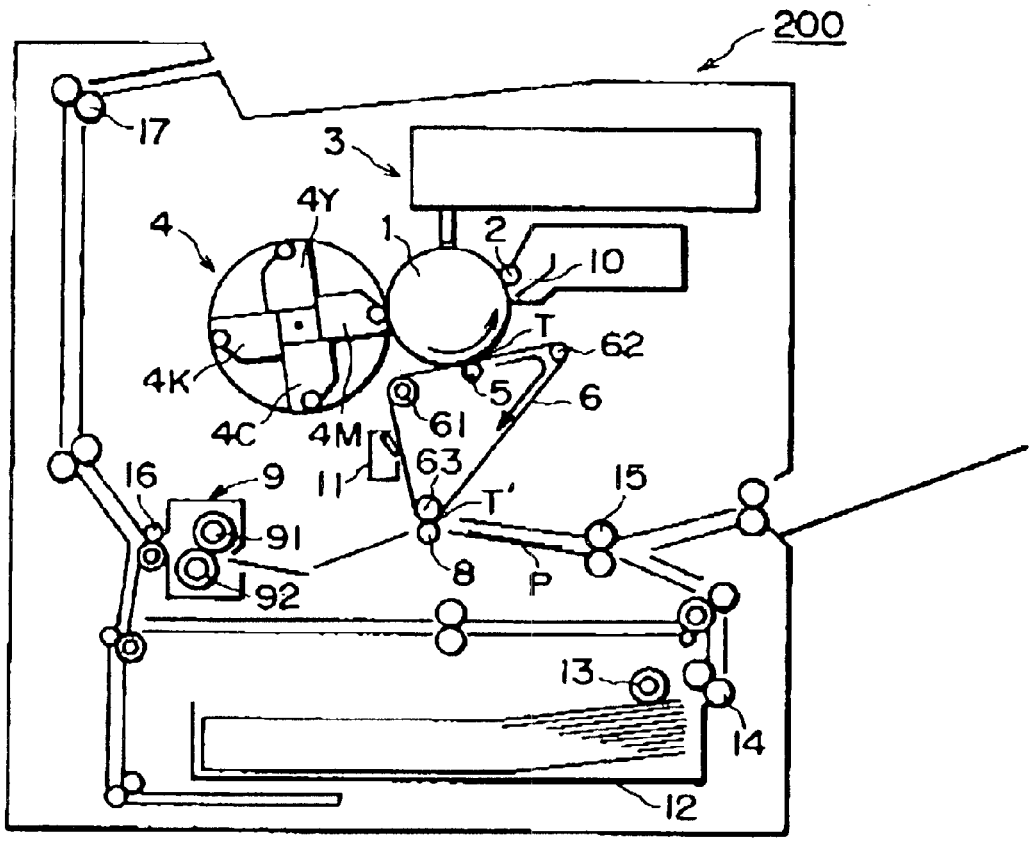
FIG. 10 is a sectional view of another example of an image forming apparatus to which the present invention is applicable, for showing the general structure thereof.
Figure 11:
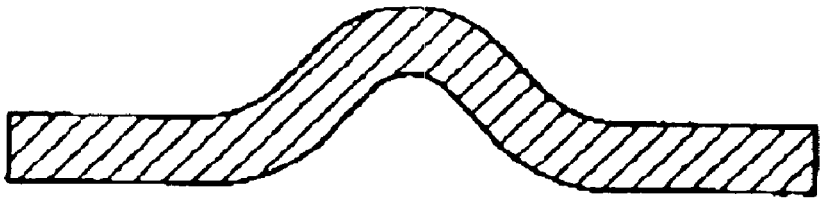
FIG. 11 is a schematic drawing of an intermediary transferring member (a) and a primary transferring station (b), for describing the problem in an image forming apparatus in accordance with the prior arts.
Figure 11:
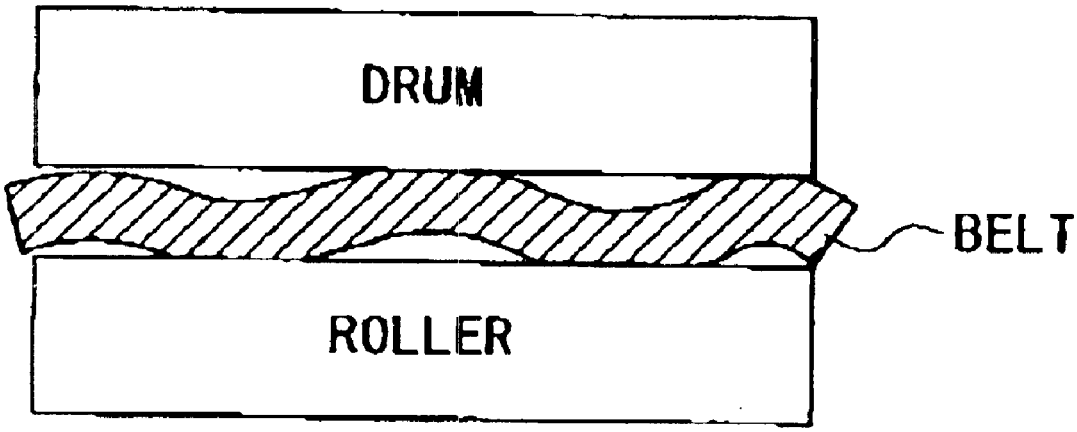
Figure 12:
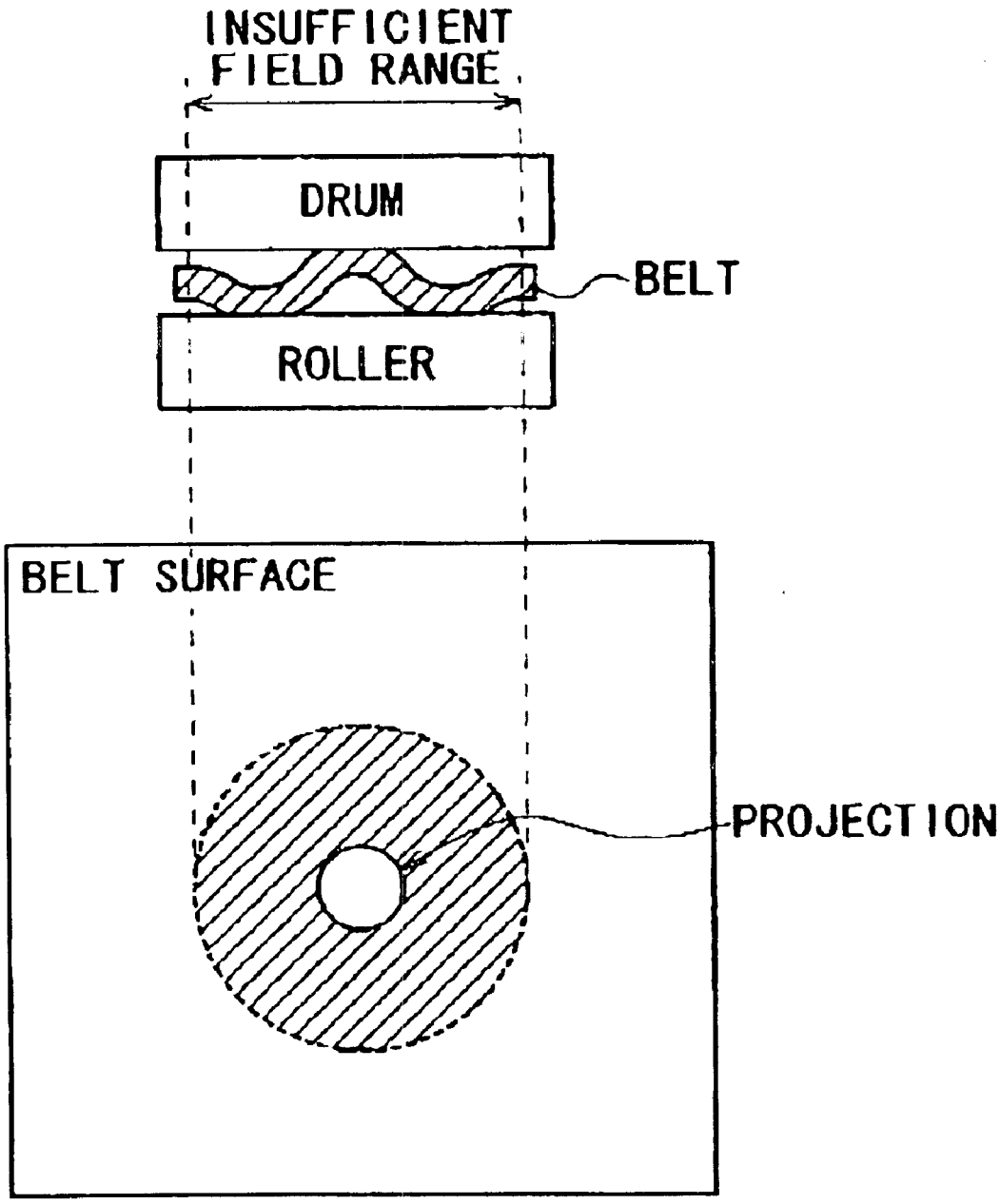
FIG. 12 ls a schematic drawing for showing the relationship between the peaks and valleys of the intermediary transferring member, and the transfer electric field, for describing the problems in an image forming apparatus in accordance with the prior arts.
Figure 13:
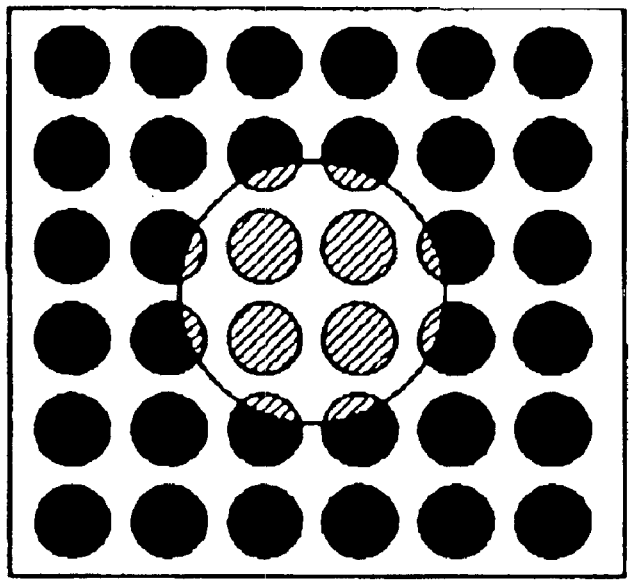
FIG. 13 is a schematic drawing for showing the image defect (a) in a solid portion of an image, and the image defect (b) in a halftone portion of an image.
Figure 13:
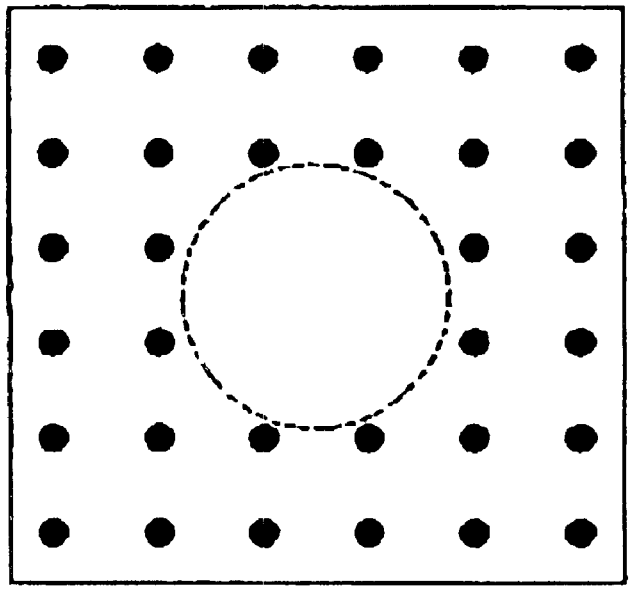

Incidentally, it is obvious that the present invention is also applicable to an image forming apparatus shown in FIG. 10, in which a plurality of electrostatic latent images sequentially formed on a single image bearing member in accordance with image formation data for a plurality of color components, are sequentially developed into a plurality of toner images by a plurality of developing means, and the thus formed plurality of toner images are transferred in layers onto the intermediary transferring member, and then, are transferred all at once onto a recording medium.

Further, in the above described embodiment, the intermediary transferring member was in the form of a belt. However, the embodiment was not intended to limit the scope of the present invention. As is evident from the above description, the employment of the intermediary transferring member in the form of a belt affords more latitude in apparatus design, making the intermediary transferring member in the form of a belt superior in terms of apparatus size reduction and spacial efficiency. However, as is well known by the people in the field of an image forming apparatus, the present invention is also applicable to the case in which a drum coated with the same material as the one coated on the above described intermediary transfer belt, or a drum manufactured by stretching around a cylindrical skeletal frame, the same material as the material, of which the above described intermediary transfer belt is made up, is used as the intermediary transferring member, with similar results.

Further, the present invention does not limit the method for charging an image bearing member, method for exposing an image bearing member, developing method, and the like, to those in the above described embodiment.

While the invention has been described with reference to the structures disclosed herein, it is not confined to the details set forth7 and this application is intended to cover such modifications or changes as may come within the purposes of the improvements or the scope of the following claims.

What is claimed is:

1. An image forming apparatus comprising:

an image bearing member for carrying a developed image;

image forming means for forming a developed image on said image bearing member;

an intermediary transfer member onto which a developed image on said image bearing member is transferred;

a transfer member, disposed at a position opposed to said image bearing member with the intermediary transfer member therebetween, for primary transfer of the developed image from said image bearing member onto said intermediary transfer member by application of a voltage thereto and pressing said intermediary transfer member to said image bearing member;

transferring means for secondary transfer of the developed image from said intermediary transfer member onto a transfer material;

wherein a maximum height Rmax ($\mu$m) representing a surface shape of said intermediary transfer member onto which the developed image is transferred, an average inclination angle θa (°) representing a surface shape of said intermediary transfer member onto which the developed image is transferred, an urging force P (N) of said transfer member onto said intermediary transfer member, and ASKER C hardness of said transfer member R (°) satisfy:

$$\theta a<2.355\times(P+11.4)/(R+94.2)-0.0174\times Rmax.$$

2. An apparatus according to claim 1, wherein the maximum height Rmax is not more than 20 ($\mu$m).

3. An apparatus according to claim 1, wherein the average inclination angle θa is not less than 0.005 (o).

4. An apparatus according to claim 1, wherein ten point average roughness Rz representing a surface shape of said intermediary transfer member onto which the developed image is transferred is not less than 0.05 ($\mu$m) and not more than 10 ($\mu$m).

5. An apparatus according to claim 1, wherein said intermediary transfer member has a volume resistivity of not less than $10^5$ (Ω.cm) and not more than $10^{12}$ (Ω.cm).

6. An apparatus according to claim 1, wherein said intermediary transfer member has a surface resistivity of not less than $10^8$ (Ω/□) and not more than $10^{14}$ (Ω/□).

7. An apparatus according to claim 1, wherein said intermediary transfer member is in the form of a belt.

8. An apparatus according to claim 7, wherein said intermediary transfer member is made of polyimide resin material.

9. An apparatus according to claim 1, wherein said transfer member is in the form of a roller.

10. An apparatus according to claim 1, wherein a plurality of such said image bearing member, a plurality of such said image forming means and a plurality of such transfer members, are provided, wherein the developed images formed on such image bearing members are sequentially transferred onto said intermediary transfer member through the primary transfer, and then the developed images are transferred onto the transfer material by said transferring means through the secondary transfer.

* * * * *

UNITED STATES PATENT AND TRADEMARK OFFICE

CERTIFICATE OF CORRECTION

PATENT NO. : 6,834,176 B2
DATED : December 21, 2004
INVENTOR(S) : Makoto Saito et al.

It is certified that error appears in the above-identified patent and that said Letters Patent is hereby corrected as shown below:

Column 4,
Line 60, "θa (*)" should read -- θa (°) --.

Column 5,
Line 1, "R (*)" should read -- R (°) --.

Column 8,
Line 36, "fore" should read -- more --.
Line 53, "an" should read -- a --.

Column 9,
Line 5, "0.05 pa," should read -- 0.05 μm, --.
Line 53, "were" should read -- was --.

Column 10,
Line 38, "0.5770*)," should read -- 0.5770°), --.
Line 59, "0.118*)," should read -- 0.118°), --.

Column 11,
Line 40, "(35' and 20')." should read -- (35° and 20°). --.
Line 42, "35'" should read -- 35°, --.
Line 43, "20'." should read -- 20°. --.
Line 44, "to" should read -- is --.
Line 63, "5'," should read -- 5°, --.

Column 12,
Line 12, "wan"should read -- was --.
Line 32, "or" should read -- member --.

Column 13,
Line 2, "R (*):" should read -- R (°): --.
Line 15, "in" (2nd occurrence) should read -- is --.
Line 59, "θa<0.24(*)." should read -- θa<0.24(°). --.

Column 14,
Line 7, "[Ehn/W]" should read -- [ΣHn/W] --.
Line 64, "is" should be deleted.

UNITED STATES PATENT AND TRADEMARK OFFICE

CERTIFICATE OF CORRECTION

PATENT NO. : 6,834,176 B2
DATED : December 21, 2004
INVENTOR(S) : Makoto Saito et al.

It is certified that error appears in the above-identified patent and that said Letters Patent is hereby corrected as shown below:

Column 16,
Line 20, "0.005 (o)." should read -- 0.005(°). --.
Line 28, "$10^5$ (Ωcm)" should read -- $10^6$ (Ωcm) --.
Line 40, "member," should read -- members, --.

Signed and Sealed this

Twenty-sixth Day of April, 2005

JON W. DUDAS
*Director of the United States Patent and Trademark Office*